US005571255A

United States Patent [19]

Baginski et al.

[11] Patent Number: 5,571,255

[45] Date of Patent: Nov. 5, 1996

[54] CIRCUIT BREAKER MECHANISM EQUIPPED WITH AN ENERGY STORAGE DEVICE WITH A DAMPING STOP

[75] Inventors: Pierre Baginski; Pierre Latapie, both of Grenoble, France

[73] Assignee: Scheider Electric SA, France

[21] Appl. No.: 500,403

[22] Filed: Jul. 10, 1995

[30] Foreign Application Priority Data

Aug. 1, 1994 [FR] France ..... 94 09732

[51] Int. Cl.[6] ..... H01H 23/00

[52] U.S. Cl. ..... 200/401; 200/400

[58] Field of Search ..... 200/400, 401; 335/6, 7, 8, 9, 10, 15, 21; 74/2

[56] References Cited

U.S. PATENT DOCUMENTS 1,988,610 1/1935 Schofield et al. .

4,935,712 6/1990 Oyama et al. ..... 200/401

5,004,875 4/1991 Moody et al. ..... 200/401

5,322,982 6/1994 Leger et al. ..... 200/401

FOREIGN PATENT DOCUMENTS 0222645 5/1987 European Pat. Off. .

2603536 8/1977 Germany .

*Primary Examiner*—David J. Walczak

*Attorney, Agent, or Firm*—Parkhurst, Wendel & Burr, L.L.P.

[57] ABSTRACT

The energy storage device of a toggle mechanism comprises a telescopic link equipped with a damping stop designed to absorb the excess energy of a main closing spring after the closing dead point of the toggle has been passed, and before the end of travel of the drive lever. This results in a better mechanical endurance of the mechanism.

6 Claims, 4 Drawing Sheets

UNLOADED AFTER PMF

CLOSED - UNLOADED

CIRCUIT BREAKER MECHANISM EQUIPPED WITH AN ENERGY STORAGE DEVICE WITH A DAMPING STOP

BACKGROUND OF THE INVENTION

The invention relates to an operating mechanism for a multipole electrical circuit breaker, having a pair of separable contacts per pole, and comprising:

a tripping hook associated to a toggle device, comprising a first rod articulated between a switching bar, and a second rod, an energy storage system having a telescopic link cooperating with an elastic device having at least one main closing spring, a drive lever arranged between the energy storage system and the second rod of the toggle device, and operating means to perform switching of the telescopic link from the loaded position to the unloaded position, and vice-versa.

A mechanism of this kind is described in the document EP-A-222,645. The excess operating energy after the closing dead point of the toggle of the mechanism is absorbed directly by the fixed drive lever pivoting travel limiting stop. This may result in premature wearing of the mechanism, notably under certain conditions of no-lead start-ups following repeated circuit breaker racking-out operations.

SUMMARY OF THE INVENTION

The object of the invention is to improve the mechanical endurance of a circuit breaker energy storage operating mechanism.

The mechanism according to the invention is characterized in that the telescopic link cooperates when unloading takes place with a damping stop designed to absorb the excess energy of the main closing spring after the closing dead point of the toggle device has been passed, and before the end of travel of the drive lever.

According to one feature of the invention, the damping stop is integrated in the telescopic link of the energy storage system.

Mechanical shocks occurring as a result of excess energy in the course of an unloading phase are thus taken up by the damping stop.

The damping effect of the integrated stop results from the elasticity of the steel parts. The damping can be adapted by providing any other absorption interface at the level of the impact zone of the part in contact.

According to an embodiment of the invention, the telescopic link comprises a cap linked to the drive lever and cooperating with sliding with a guide, and a slide arranged as an intermediate slide-rack between the guide and cap, said slide being equipped with a retaining edge designed to interfere with a conjugate shoulder of the cap to form said damping stop.

The main compression spring is inserted between a bearing surface of the cap and a base of the slide, said base being situated opposite the edge. An auxiliary polarization spring is inserted coaxially inside the slide between the guide and a longitudinal extension of the cap.

BRIEF DESCRIPTION OF THE DRAWINGS

Other advantages and features of the invention will become more clearly apparent from the following description of an embodiment of the invention, given as a non-restrictive example only, and represented in the accompanying drawings in which.

DETAILED DESCRIPTION OF THE PREFERRED EMBODIMENT

Figure 1:
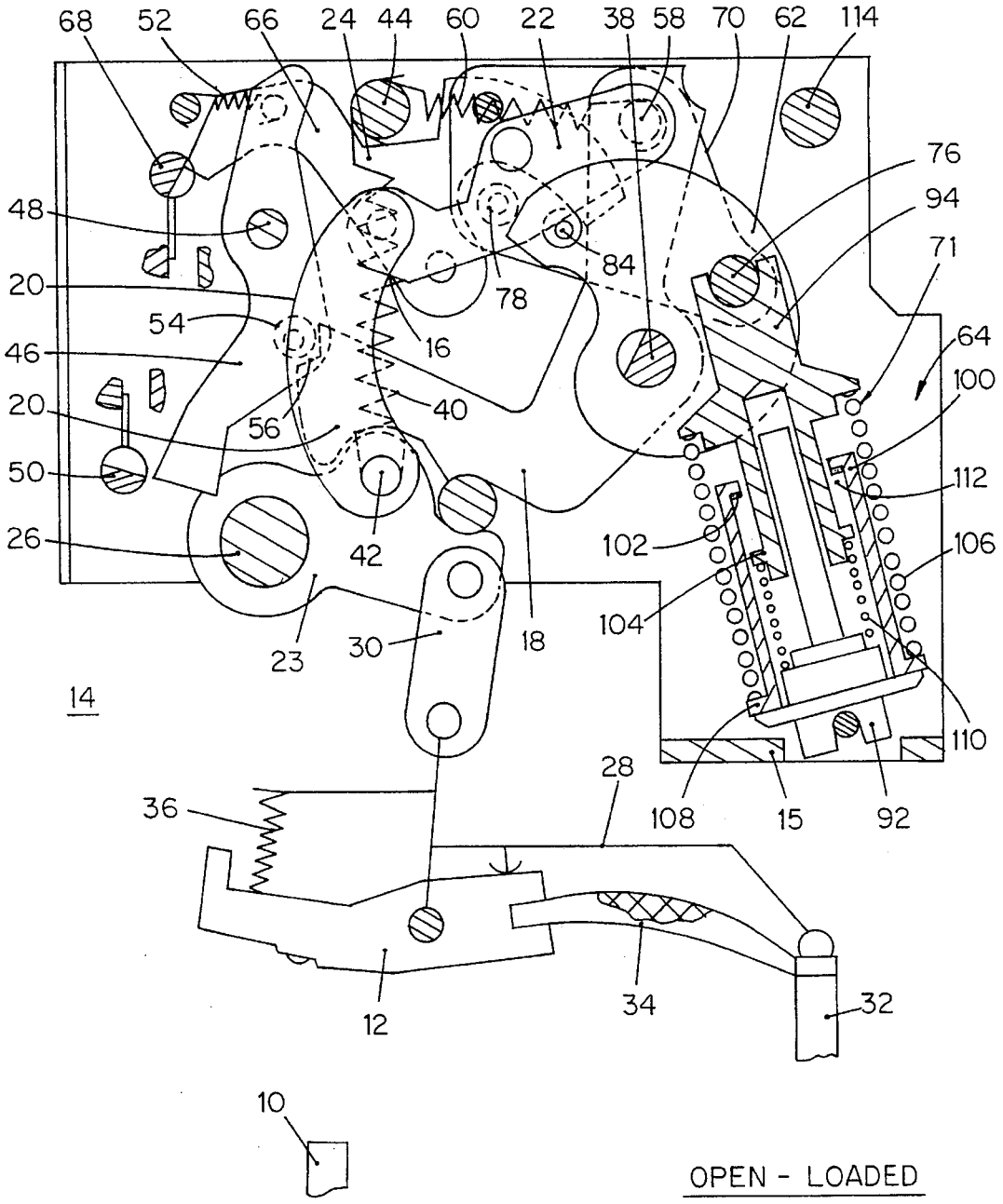
FIG. 1 shows a schematic view of the mechanism equipped with the energy storage system according to the invention, the mechanism being represented in the open-loaded state corresponding to the open position of the contacts and to the loaded position of the energy storage system.
Figure 2:
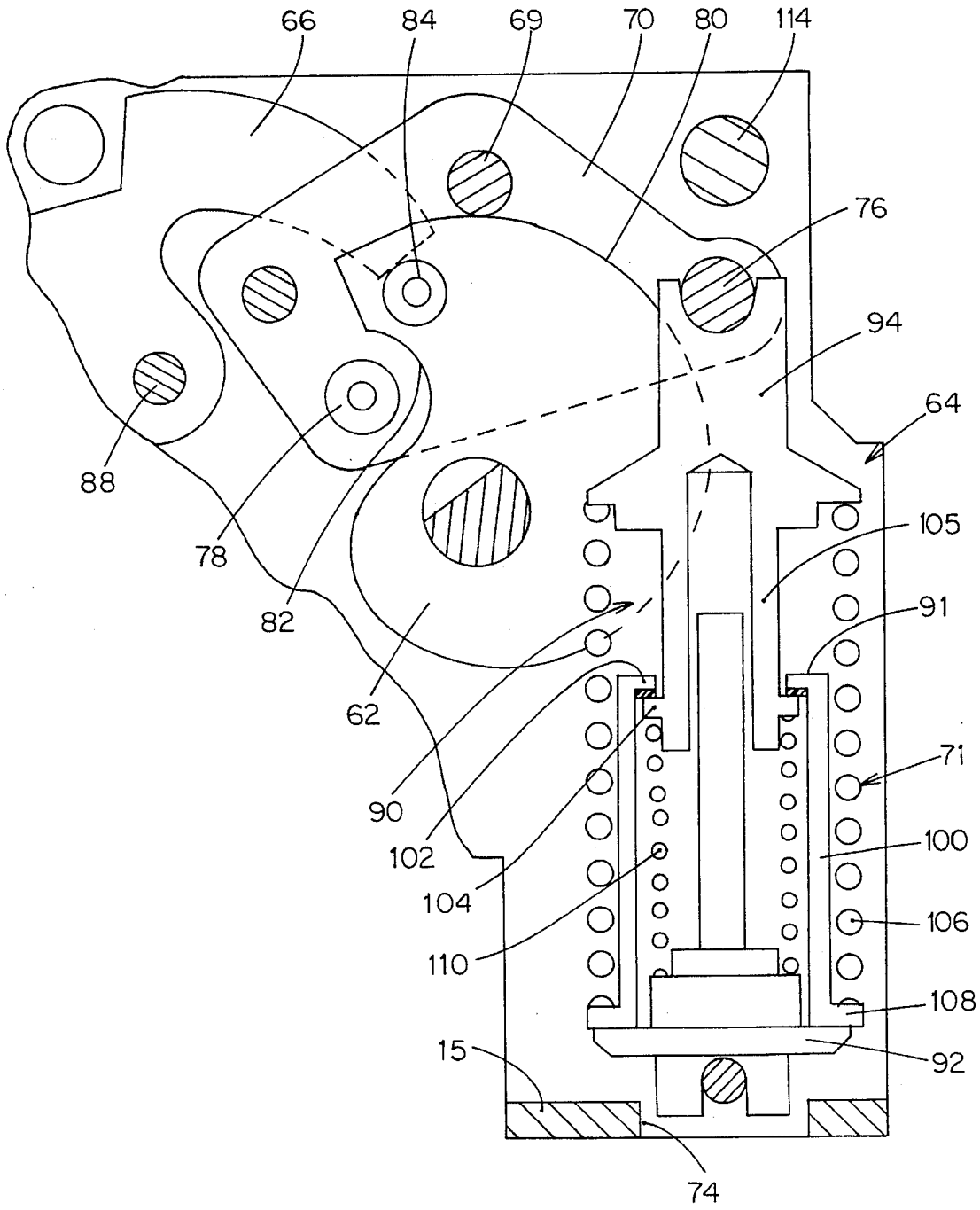
FIG. 2 is a partial enlarged scale view of FIG. 1, showing the energy storage system in the unloaded position after the dead point of the toggle has been passed.
Figure 3:
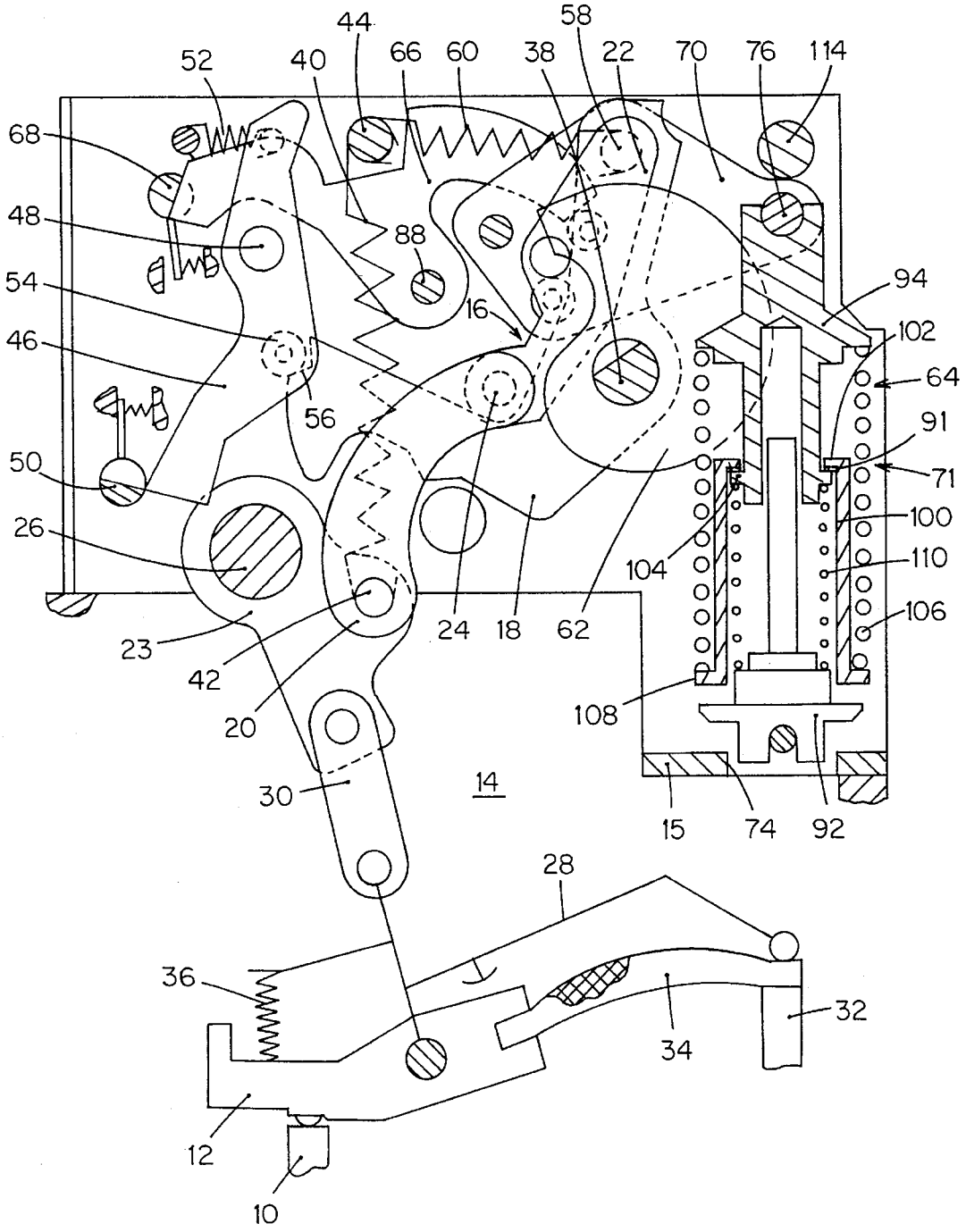
FIG. 3 is an identical view to FIG. 1, in the closed-unloaded state of the mechanism, corresponding to the closed position of the contacts and to the unloaded position of the energy storage system.

In FIGS. 1 to 3, a multipole electrical circuit breaker having at least one pair of separable contacts 10, 12 per pole is actuated by an operating mechanism 14 supported by a frame with parallel flanges 15 comprising a toggle device 16 associated to a tripping hook 18.

The toggle device 16 comprises a pair of rods 20, 22 articulated on a pivoting spindle 24, the lower transmission rod 20 being mechanically coupled to a transverse switching bar 23 common to all the poles. The bar 23 is formed by a shaft 26 mounted in rotation between an open position and a closed position of the contacts 10, 12. At the level of each pole there is arranged a linking rod 30 which links a crank of the bar 23 to an insulating support cage 28 of the movable contact 12. The latter is connected to a connection terminal pad 32 by a flexible conductor 34, notably a braided strip. A contact pressure spring 36 is arranged between the cage 28 and the upper face of each movable contact 12.

The tripping hook 18 is pivotally mounted on a fixed main spindle 38 between a loaded position (FIG. 1) and a tripped position. An opening spring 40 is secured between a spur 42 of the bar 23 and a fixed retaining lug 44 located above the toggle device 16. An opening ratchet 46, formed by a locking lever pivotally mounted on a spindle 48, is operated by a first latching bolt 50 in the shape of a half-moon. A return spring 52 of the opening ratchet 46 is located opposite the first latching bolt 50 with respect the spindle 48. A stop 54 arranged on the opening ratchet 46 between the spindle 48 and bolt 50 cooperates in the loaded position with a V-shaped recess 56 of the tripping hook 18. The upper rod 22 of the toggle 16 is articulated on a spindle 58 of the tripping hook 18 opposite the recess 56. A return spring 60 fixed between the spindle 58 and lug 44 urges the hook 18 counterclockwise to the loaded position (FIG. 1), in which the stop 54 of the opening ratchet 46 is positioned in the V-shaped recess 56 of the hook 18.

The mechanism 14 comprises a resetting cam 62 keyed onto the main spindle 38 of the hook 18 and cooperating with an energy storage system 64.

In addition to the resetting cam 62, the energy storage system 64 is equipped with a closing ratchet 66 operated by a second latching bolt 68, and with a drive lever 70 pivotally mounted on a spindle 69. An elastic energy storage device 71 is arranged between a housing 74 of the frame and a transmission finger 76 of the drive lever 70. The resetting cam 62 cooperates with a roller 78 of the drive lever 70, and the elastic energy storage device 71 urges this drive lever up against the cam 62. The profile of the cam 62 comprises a first sector 80 for loading the closing spring 71, and a second sector 82 corresponding to release of the roller 78 allowing high-speed counterclockwise pivoting of the drive lever 70 due to the expansion action of the elastic device 71. The resetting cam 62 is moreover equipped with a pin 84 designed to come up against the closing ratchet 66 when the end of the first sector 80 of the cam 62 is pressing against the roller 78 of the drive lever 70.

In the stable position of FIG. 1, in the loaded position of the energy storage system 64, the contacts 10, 12 are either in the open position or in the closed position, depending on the state of the toggle device 16. The roller 78 pressing on the first sector 80 exerts a torque on the resetting cam 62 urging the latter in clockwise rotation. The closing ratchet 66 opposes this rotation due to the retaining action of the pin 84 of the cam 62.

The mechanism 14 cooperates with a magnetothermal or electronic trip device (not represented) to bring about automatic opening of the contacts 10, 12 in the event of an overload or a fault. After opening of the contacts 10, 12 by the toggle device 16, a closing operation can be ordered by actuating the second bolt 68 causing counterclockwise pivoting of the closing ratchet 66 around its spindle 88. This results in release of the pin 84 causing, due to the action of the roller 78, clockwise pivoting of the cam 62 moving the second sector 82 of the cam 62 to the position releasing the drive lever 70. The latter is then driven counterclockwise by the expansion of the elastic device 71 so as to transmit a closing force to the toggle device 16 moving the contacts 10, 12 to the closed position (FIG. 3). This closing operation takes place against the force of the opening spring 40, which is thus automatically loaded when expansion of the elastic device 71 takes place.

The operation of a mechanism of this kind is described in detail in the document EP-A-222,645 filed by the applicant, and resetting of the energy storage system 64 by compression of the elastic device 71 is performed manually or automatically by means of an operating lever or a geared motor (not represented) keyed onto the main spindle 38. This resetting operation by rotation of the cam 62 is explained in detail in the document FR-A-2,558,986 filed by the applicant. Driving of the main spindle 38 in rotation is performed clockwise until the pin 84 of the cam 62 comes up against the closing ratchet 66. The resetting cam 62 rotates with the main spindle 38 in the same direction of rotation and occupies two stable positions, i.e. a loaded position (FIG. 1) in which the cam 62 is locked by the closing ratchet 66, and an unloaded position (FIG. 3) allowing release of the drive lever 70 and expansion of the elastic device 71.

According to the invention, the elastic device 71 of the energy storage system 64 for closing of the circuit breaker contacts 10, 12 comprises a telescopic link 90 in which a damping stop 91 is integrated. The telescopic link 90 is equipped with a guide 92 positioned in the housing 74 of the frame, and a cap 94 able to slide along the guide 92 and comprising a notch for housing the finger 76 of the drive lever 70. A slide 100 in the form of an intermediate slide-rack is inserted between the guide 92 and cap 94 and comprises an annular edge 102 cooperating with a conjugate shoulder 104 situated on a longitudinal extension 105 of the cap 94 to form the damping stop 91.

A main compression spring 106 is inserted between the cap 94 and an external base 108 of the slide 100, which base is located opposite the edge 102. An auxiliary polarization spring 110 is arranged coaxially inside the slide 100 and bears on the guide 92 and shoulder 104 of the longitudinal extension 105 of the cap 94. The stiffness of the auxiliary spring 110 is lower than that of the main spring 106.

In the open-loaded state of the mechanism 14 illustrated in FIG. 1, the resetting cam 62 is locked in the loaded position by the closing ratchet 66 and the two springs 106, 110 are compressed to the maximum by the relative movement of the cap 94 towards the guide 92. The edge 102 of the slide 100 is separated longitudinally from the shoulder 104 of the cap 94 by a preset distance 112.

After unlocking of the cam 62 by the unlocking action of the closing ratchet 66, expansion of the main spring 106 causes counterclockwise pivoting of the drive lever 70 around the spindle 69. The drive lever 70 acts on the upper rod 22 so as to drive the toggle device 16 to an intermediate position corresponding to overshooting of the closing dead point. The energy storage system 64 is then in the position of FIG. 2, in which the shoulder 104 of the cap 94 comes into engagement against the edge 102 of the slide 100 so as to constitute the damping stop 91 designed to absorb the excess energy of the spring 106 before the drive lever 70 comes into contact against the fixed stud 114. The presence of this damping stop 91 results from the elasticity of the steel parts, which could be increased by means of an elastic ring (not represented) arranged either on the shoulder 104 or on the edge 102. The elastic ring could naturally be replaced by any other absorption interface.

In the closed-unloaded state illustrated in FIG. 3, the contacts 10, 12 are in the closed position and the auxiliary spring 110 polarizes the drive lever 70 against the fixed stud 114.

Figure 4:
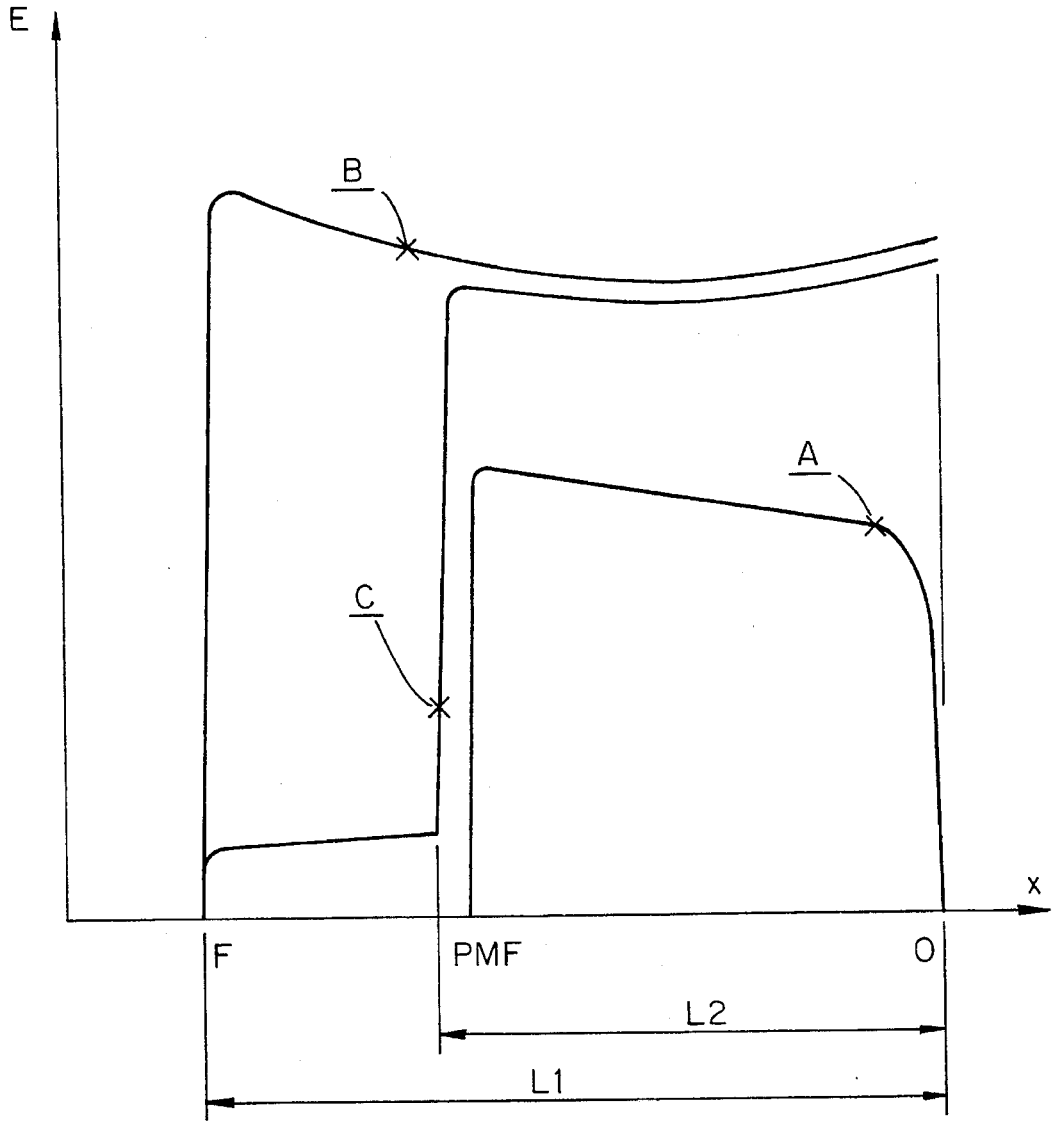
FIG. 4 shows different diagrams representing the variation of operating energy of a known mechanism (curve B) and of a mechanism according to the invention (curve C) versus the travel of the movable assembly.

In FIG. 4, the operating energy required to close the circuit breaker contacts 10, 12 is presented by curve A, which extends between the open position o of the contacts and the intermediate point PMF of closing dead point passage. Curve B illustrates the closing energy of a conventional mechanism for the total travel L1 of the drive lever 70, notably that described in the document EP-A-222,645. Curve C reflects the closing energy of the mechanism according to the invention, due to the presence of the damping stop 91 inside the telescopic link 90 enabling the excess energy to be absorbed after the product PMF of closing dead point passage. The travel L2 is smaller than the travel L1, which improves the endurance of the mechanism 14.

The presence of the damping stop 91 also enables the number of no-load start-ups of the circuit breaker to be increased. Certain standards do in fact impose unloading of the energy storage mechanism when the circuit breaker is racked out, regardless of whether the contacts are in the open or the closed position. An unloading lever (not represented) is made active when the circuit breaker racking-out travel takes place to act on the latching bolt 68 so as to unlock the closing ratchet 66 automatically resulting in expansion of the springs 106, 110.

The energy storage system 64 with the stop 91 can be integrated either directly in the mechanism 14 of a monobloc circuit breaker or in a remote control unit mechanically coupled to the circuit breaker unit.

The resetting cam 62 can be replaced by any other means of performing loading of the closing spring.

We claim:

1. An operating mechanism for a multipole electrical circuit breaker having a pair of separable contacts per pole, comprising:

a tripping hook connected to a toggle device, said toggle device comprising a first rod articulated between a switching bar and a second rod, said toggle device being arranged to provide a closing dead point;

an energy storage system comprising a telescopic link and an elastic device for biasing the telescopic link, said elastic device comprising at least one main compression spring;

a drive lever interconnecting the energy storage system and the second rod of the toggle device;

operating means for switching the telescopic link between loaded and unloaded positions; and a damping stop designed to absorb excess energy of the main closing spring upon unloading of the telescopic link, after the closing dead point of the toggle device has been passed.

2. The circuit breaker operating mechanism according to claim 1, wherein the damping stop is integrated in the telescopic link of the energy storage system.

3. The circuit breaker operating mechanism according to claim 2, wherein the telescopic link comprises a cap having a shoulder, said cap being connected to the drive lever and being slidably connected to a slide, said slide being equipped with a retaining edge designed to abut the shoulder of the cap to form said damping stop.

4. The circuit breaker operating mechanism according to claim 3, wherein the telescopic link further comprises a guide, each of said slide and said cap being slidable with respect to said guide, an auxiliary polarization spring is inserted coaxially inside the slide between the guide and a longitudinal extension of the cap to bias said cap with respect to the guide, and the main compression spring is inserted between said cap and a base portion of the slide to bias said cap with respect to the slide.

5. The circuit breaker operating mechanism according to claim 4, wherein the shoulder extends from the longitudinal extension of the cap, and the auxiliary spring bears against the shoulder.

6. The circuit breaker operating mechanism according to claim 3, wherein the damping stop contains elastic mechanical shock absorption means.

* * * * *